US006201848B1

(12) United States Patent
Brancato

(10) Patent No.: US 6,201,848 B1
(45) Date of Patent: Mar. 13, 2001

(54) ARTICLE COUNTER WITH IMPROVED LIGHT BEAM COVERAGE

(75) Inventor: Dominic S. Brancato, Gladstone, MO (US)

(73) Assignee: Count On Us, Corporation, Kansas City, MO (US)

( * ) Notice: Subject to any disclaimer, the term of this patent is extended or adjusted under 35 U.S.C. 154(b) by 0 days.

(21) Appl. No.: 09/432,531

(22) Filed: Nov. 3, 1999

Related U.S. Application Data

(60) Provisional application No. 60/140,391, filed on Jun. 22, 1999.

(51) Int. Cl.[7] ..... G06M 11/00
(52) U.S. Cl. ..... 377/6; 377/8
(58) Field of Search ..... 377/6, 8

(56) References Cited

U.S. PATENT DOCUMENTS 4,484,066 * 11/1984 DeBlieux et al. ..... 235/98 C
4,849,999 * 7/1989 Humphreys et al. ..... 377/6

* cited by examiner

*Primary Examiner*—Margaret R. Wambach
(74) *Attorney, Agent, or Firm*—Shughart Thomson & Kilroy P.C.

(57) ABSTRACT

A five sided chamber is placed in a laundry chute such that any laundry article passing through the chute must also pass through the chamber. The five sided chamber is mirrored on the inside surfaces of four of the five sides while the fifth side is transparent. A light beam emitter and a light beam receiver are positioned along the transparent fifth side of the chamber. The light beam emitter is directed at the center of one of the four mirrored sides and the light beam receiver is directed at the center of an adjacent one of the four mirrored sides. Reflection of the light beam internally within the five sided chamber is such that the light beam forms a star pattern before returning to the light beam receiver via the transparent fifth side. This star pattern insures that any article of laundry passing through the chute will block at least a portion of the star shaped light beam and toggle an electronic counter connected to the light beam receiver for increased accuracy and reliability in laundry item counting.

5 Claims, 1 Drawing Sheet

ARTICLE COUNTER WITH IMPROVED LIGHT BEAM COVERAGE

CROSS REFERENCE TO RELATED APPLICATIONS

This application is a continuation of provisional application Ser. No. 60/140,391, filed Jun. 22, 1999 and entitled ARTICLE COUNTER WITH IMPROVED LIGHT BEAM COVERAGE.

BACKGROUND OF THE INVENTION

1. Field of the Invention

This invention is directed to an article counter, and, more particularly, to such an article counter designed for use by a commercial laundry. As articles to be laundered pass through a pneumatic chute, they drop through a special chamber in which a light beam is internally reflected within a five sided chamber to form a star shaped pattern and then directed to a light beam receiver. The star shaped pattern offers much improved light beam coverage of the chamber such that any article passing through any part of the chamber will pass through at least one of the reflected beams, thus reliably breaking the beam and toggling a counter.

2. Description of the Related Art

Counters for counting articles, such as laundry articles, passing through a chute are well known. Many such counters operate by the use of a light beam emitter positioned on one side of the chute directing light to a light beam receiver on the opposite side of the chute. An electronic counter is triggered by each interruption of the beam by an article of laundry passing through the chute.

A problem with these prior art arrangements is the limited beam coverage of the chute. In other words, a single beam of light passing through the center of the chute can be missed by a small article of laundry, such as a napkin, handkerchief or the like, dropping through the chute along one side thereof. This results in inaccurate article counts and a consequent loss of revenue to the laundry since charges are typically made based upon counted numbers of laundered articles.

It is clear then, that a need exists for an improved commercial laundry article counter. Such a counter should insure that even small laundry items passing through a chute are guaranteed to break a portion of the light beam and thus toggle the counter.

SUMMARY OF THE INVENTION

In the practice of the present invention, a special, five sided chamber is placed in a laundry chute such that any laundry article passing through the chute must also pass through the chamber. Four of the five sides of the chamber are mirrored on the inside surface thereof and a light beam emitter and a light beam receiver are positioned along the remaining side of the chamber, which is transparent to allow light beams to enter and exit the chamber. The light beam emitter is directed at the center of one of the four mirrored sides and the light beam receiver is directed at the center of an adjacent one of the four mirrored sides. Reflection of the light beam internally within the five sided chamber is such that the light beam forms a star pattern before returning to the light beam receiver. This star pattern gives much greater light beam coverage to the chamber than with prior art light beam counters and insures that any article of laundry passing through the chute will block at least a portion of the star shaped light beam. An electronic counter is connected to the light beam receiver and is responsive to any breaking of the light beam to register a count with each passage of an article of laundry.

OBJECTS AND ADVANTAGES OF THE INVENTION

The principle objects and advantages of the present invention include: to provide an improved article counter; to provide such an article counter which is designed especially for commercial laundries; to provide such an article counter in which a five sided chamber is internally mirrored along four sides thereof, with the internal mirrors being positioned to reflect a light beam from a light beam emitter to a light beam receiver; to provide such an article counter in which the fifth side is transparent to allow light from the emitter to enter the chamber and reflected light to exit the chamber; to provide such an article counter which has greatly improved beam coverage, and thus counter accuracy when compared to prior art counters; and to provide such an article counter which is reliable and economical to manufacture and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
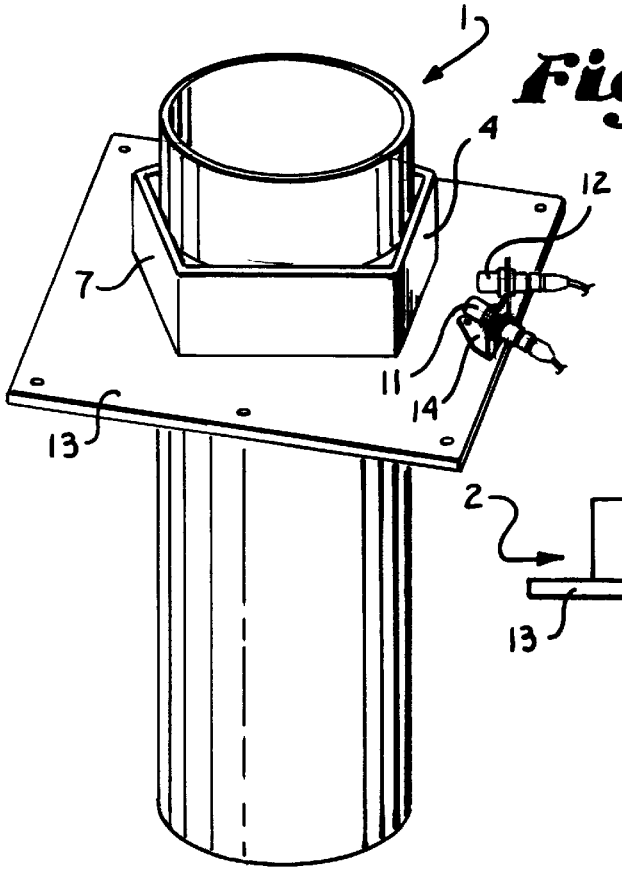
FIG. 1 is a perspective view of a laundry chute and five sided light beam chamber in accordance with the present invention.
Figure 3:
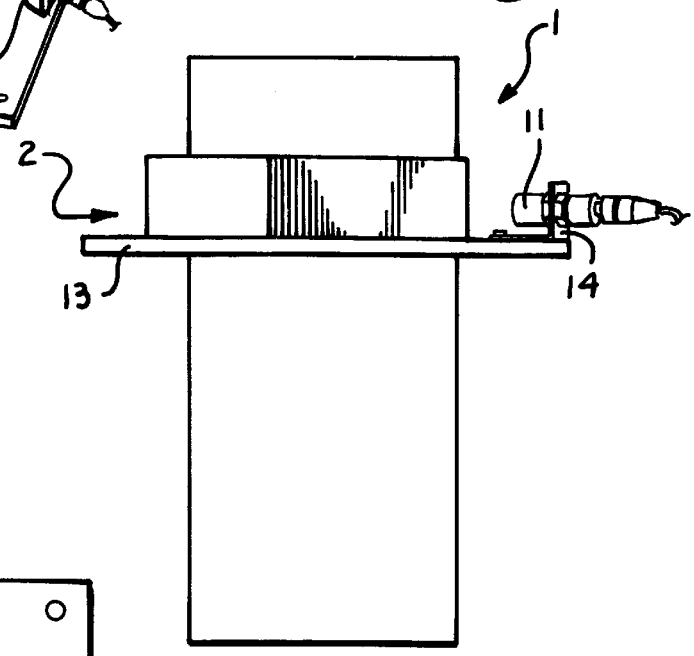
FIG. 3 is a front elevation view of the laundry chute and chamber of FIG. 1.
Figure 2:
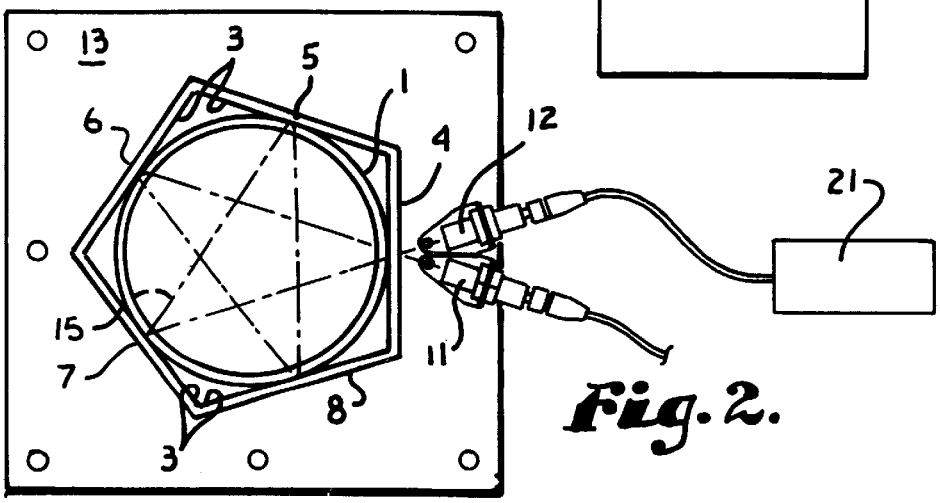
FIG. 2 is a top plan view of a laundry chute and five sided light beam chamber illustrating the placement of a light beam emitter and receiver and the internal reflection of the light beam.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail the reference numeral 1 generally designates a laundry chute which is generally cylindrical in shape. The laundry chute 1 can be, for example, pneumatically operated to move laundry articles from one position to another, or it can be merely gravity operated. In either instance, laundry items (not shown), enter the top of the chute 1 and exit the bottom thereof.

Positioned within the chute 1 is a five-sided chamber 2 with sides 4–8. The chamber 2 has mirrors 3 on sides 5–8 while side 4 is transparent. A light beam emitter 11 and a light beam receiver 12 are positioned outside the chamber 2 proximate side 4 of the chamber 2 on a support flange 13 via respective mounting brackets 14. The light beam emitter 11 is positioned such that a light beam 15 emitting therefrom strikes the side 6 in the center thereof. The beam 15 is reflected to the center of the side 8, reflected again to the center of the side 5, is reflected again to the center of the side 7, and from there back to and through the transparent side 4 and to the beam receiver 12.

An electronic counter, indicated at block 21, is connected to the beam receiver 12, and is operative to register a count each time the beam is interrupted by an article of laundry passing through the chamber 2. Since the beam 15 is reflected four times before exiting the chamber 2, it forms a star pattern, which substantially covers the entire center of the chamber 2 such that any laundry article, no matter how small, passing through the chute 1 will interrupt some portion of the star shaped beam 15, thus temporarily shutting off light to the light beam receiver 12, which, in turn, toggles the counter 21 to increment the current count by 1. This insures that each laundry item is counted and counted accurately, thus providing a fair and accurate count for both the customer and the laundry operator.

While the invention has been specifically described and illustrated, variations will occur to those of ordinary skill in the art. For example, the number of internally mirrored sides in the chamber 2 could be more or less than four. The light beam emitter 11 and light beam receiver 12 could be positioned along different sides of the chamber 2. The chute 1, although illustrated as cylindrical, could be any shape in cross section, such as rectangular, or even pentagonal to match the chamber 2. It is thus to be understood that while certain forms of the present invention have been illustrated and described herein, it is not to be limited to the specific forms or arrangement of parts described and shown.

I claim:

1. An article counter adapted to be positioned within a chute via which articles to be counted are conveyed past the article counter, said article counter comprising:

a) a chamber containing at least three sides, two of which are internally mirrored with a third side being at least partially transparent;

b) a light beam emitter positioned proximate the third side, said light beam emitter directing a light beam at one of the internally mirrored sides;

c) a light beam receiver also positioned proximate the third side, said light beam receiver being positioned to detect a light beam reflected from another one of the internally mirrored sides; and d) a counter responsive to the light beam receiver to count the number of times the light beam is broken by an article passing through the chamber.

2. An article counter as in claim 1, wherein:

a) there are four of said internally mirrored sides arrayed, along with said transparent side, into a pentagonal shape, and b) said light beam emitter is directed toward one of said four internally mirrored sides and said light beam receiver is directed toward another one of said internally mirrored sides which is adjacent to said one of said four internally mirrored sides such that said light beam is internally reflected by said four internally mirrored sides within said chamber to form a star shaped pattern.

3. A laundry article counter adapted to be positioned within a chute via which laundry articles to be counted are conveyed past the article counter, said article counter comprising:

a) a chamber containing five sides arrayed in a pentagonal shape, four of which are internally mirrored with a fifth side being at least partially transparent;

b) a light beam emitter positioned proximate the fifth side, said light beam emitter directing a light beam at one of the internally mirrored sides;

c) a light beam receiver also positioned proximate the fifth side, said light beam receiver being positioned to detect a light beam reflected from another one of said internally mirrored sides which is adjacent to said one of said four internally mirrored sides, said four internally mirrored sides reflecting said light beam into a star shaped pattern; and d) a counter responsive to the light beam receiver to count the number of times the light beam is broken by a laundry article passing through the chamber.

4. A method of improving the light beam coverage of an article counter which is adapted to be positioned within a chute via which articles to be counted are conveyed, said method comprising the steps of:

a) providing said article counter with a chamber containing at least three sides, two of which are internally mirrored with a third side being at least partially transparent;

b) positioning a light beam emitter proximate the third side such that said light beam emitter is positioned to direct a light beam toward one of the internally mirrored sides;

c) positioning a light beam receiver proximate the third side such that said light beam receiver is positioned to detect a light beam reflected from another one of the internally mirrored sides; and d) connecting a counter to the light beam receiver such that it is responsive to said light beam receiver to count the number of times the light beam is broken by an article passing through the chamber.

5. A method as in claim 4, wherein:

a) said providing step includes providing said chamber with five sides arrayed in a pentagonal shape with four of the five sides being internally mirrored and forming, with said transparent side, a pentagonal shape;

b) said light beam emitter positioning step includes directing said light beam emitter through said transparent side toward one of said four internally mirrored sides; and c) said light beam receiver positioning step includes directing said light beam receiver toward another one of said internally mirrored sides which is adjacent to said one of said four internally mirrored sides such that said light beam is internally reflected by said four internally mirrored sides within said chamber to form a star shaped pattern.

* * * * *